United States Patent [19]

Takei

[11] 4,350,223

[45] Sep. 21, 1982

[54] SILENCER

[75] Inventor: Hirofumi Takei, Yokosuka, Japan

[73] Assignee: Nissan Motor Co., Ltd., Yokohama, Japan

[21] Appl. No.: 222,392

[22] Filed: Jan. 5, 1981

[30] Foreign Application Priority Data

Jan. 16, 1980 [JP] Japan ..... 55-3687[U]

[51] Int. Cl.[3] ..... F02M 35/12; F01N 1/02

[52] U.S. Cl. ..... 181/229; 181/250

[58] Field of Search ..... 181/227–229, 181/241, 246, 250, 273, 282, 266, 276, 214; 55/276

[56] References Cited

U.S. PATENT DOCUMENTS

| | | | |
|---|---|---|---|
| 1,447,749 | 3/1923 | Beselin | 181/228 X |
| 2,468,454 | 4/1949 | Mason | 181/250 X |
| 4,239,091 | 12/1980 | Negrao | 181/246 X |

FOREIGN PATENT DOCUMENTS

| | | |
|---|---|---|
| 1244293 | 8/1971 | United Kingdom . |
| 1393232 | 5/1975 | United Kingdom . |
| 1550194 | 8/1979 | United Kingdom . |

*Primary Examiner*—L. T. Hix
*Assistant Examiner*—Thomas H. Tarcza
*Attorney, Agent, or Firm*—Thompson, Birch, Gauthier & Samuels

[57] ABSTRACT

A silencer consisting of a porous metal tube disposed in a housing and a resonance chamber formed between the exterior of the tube and the interior of the housing. The housing is made of a flexible non-metallic material which is highly resistant to excitement by vibration from an external source and/or vibration from the porous tube and accordingly is highly resistant to the generation of secondary noise. The silencer is supported and isolated from external vibrations by flexible conduits connected to each end of the porous tube.

7 Claims, 3 Drawing Figures

SILENCER

BACKGROUND OF THE INVENTION

1. Field of the Invention

The present invention relates generally to silencers and more specifically to an automotive silencer constructed to both silence noise generated within and not produce secondary noise due to excitement by vibrational energy transmitted thereto from an external source.

2. Description of the Prior Art

In a known arrangement shown in FIG. 1 of the drawings, a metal tube 1 has been partially enclosed in a metal housing 2 to define a resonance chamber 3 which fluidly communicates with the interior of the metal tube 1 through a plurality of perforations or holes 4. The housing is formed of a metal tube 5 and inwardly extending metal flange members 6. However, this arrangement, while adequately damping fluid flow noise and the like, has suffered from the drawback that the rigid metal construction has provided a surface or surfaces which upon excitement from an external source of vibrational energy, such as an internal combustion engine, emit secondary noise.

SUMMARY OF THE INVENTION

The present invention features a combination of a porous metal tube enclosed within a non-metallic housing formed of a suitably stiff material such as glass fiber and phenolic resin. Flexible conduits such as corrugated plastic or rubber hose are connected to each end of the porous metal tube in order to both support and isolate the silencer from external vibration. This arrangement is able to more effectively suppress induction (or exhaust) noise while being extremely resistant to excitement by vibration from an external source and the subsequent production of secondary noise.

BRIEF DESCRIPTION OF THE DRAWINGS

The features and advantages of the present invention will become more clearly appreciated from the following description taken in conjunction with the accompanying drawings in which like reference numerals denote corresponding elements, and in which.

DETAILED DESCRIPTION OF THE PREFERRED EMBODIMENT

Figure 1:
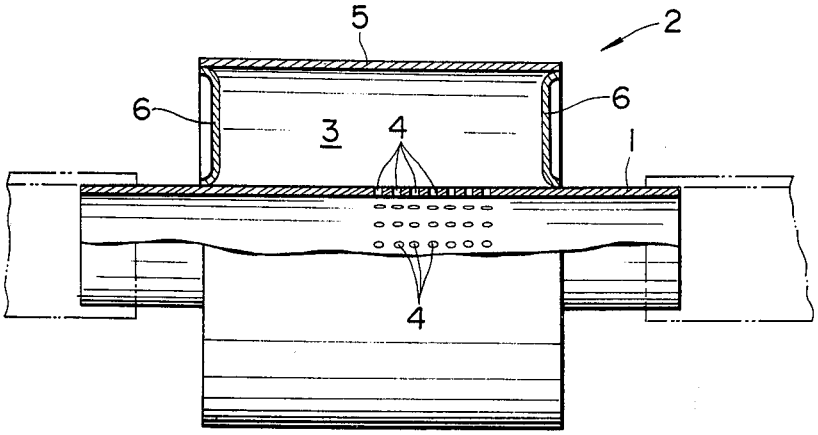
FIG. 1 (PRIOR ART)
FIG. 1 is an elevational view partly in section of the prior art arrangement discussed under the heading of "Description of the Prior Art"
Figure 2:
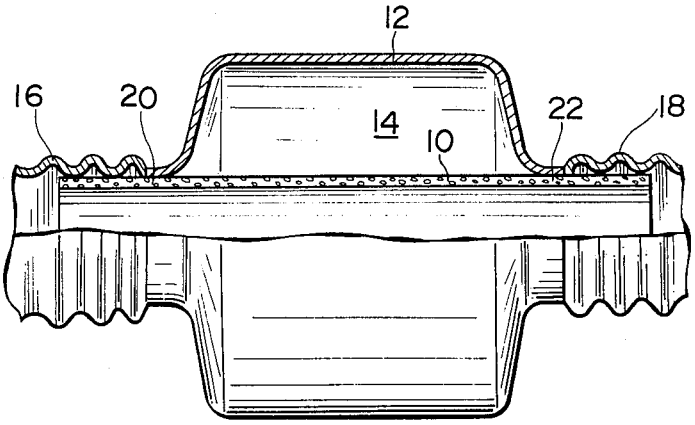
FIG. 2 is an elevational view partly in section of the preferred embodiment of the present invention.

Turning now to the drawings and in particular FIG. 2, a preferred embodiment of the silencer of the present invention is shown. In this figure, the numeral 10 denotes a porous metal tube which can be made of sintered powdered aluminium or other suitable foam metal. The tube itself can be formed initially in a sheet and subsequently rolled and welded or formed into a tube by any other suitable process. The porous metal tube 10 is sealingly disposed through an outer housing member 12 which encloses a part of the tube 10 to define a closed resonance chamber 14. Conduits 16 and 18 made of corrugated elastomeric tubing or the like are each sealingly fitted onto the ends 20, 22 of the porous metal tube projecting out of the housing 12. The conduits also sealingly abut the housing 12 so as to define an airtight arrangement. These conduits furthermore can be used advantageously to support the silencer and prevent the transmission of vibration thereto.

With this arrangement, noise produced by fluid flow through the tube 10 and conduits 16 and 18 is suppressed due to the very fine pore structure of the porous metal tube 10 and because such a material exhibits excellent damping characteristics, any vibration transmitted thereto from an external source will be absorbed. Hence, internal noise as well as external vibration are damped, preventing the tube 10 from acting as a source of secondary noise. The outer housing, due to its non-metallic and flexible nature, is likewise resistant to excitement by external vibration or vibration from the metal tube 10 and further adds to the absorption of any noise in the resonance chamber 14. The housing 12 of course must have sufficient structural rigidity to prevent deformation thereof upon a sub-atmospheric or greater than atmospheric pressure prevailing therein as will occur in the induction or exhaust systems of an internal combustion engine during the operation of same.

The outer housing 12 can be initially formed into a sheet and subsequently formed and bonded or otherwise joined, or formed in two halves to be connected along the two seams thereof. The outer housing may be formed of either organic or inorganic fiber and a cross-linked phenolic resin, the combination of which is hot molded. The inner surface of the outer housing is preferably provided with a thin layer of elastomer such as polyethylene, polypropylene or other suitable synthetic rubber. Alternatively, the outer housing may be formed by hot pressing a sandwich consisting of a core of foamed synthetic resin such as polyethylene and a thermohardening resin such as a polyester resin and outer layers formed by impregnating the core with a thermohardening resin. This process is suited to forming the outer housing in two half shells which may be bonded together to form an airtight resonance chamber 14.

Figure 3:
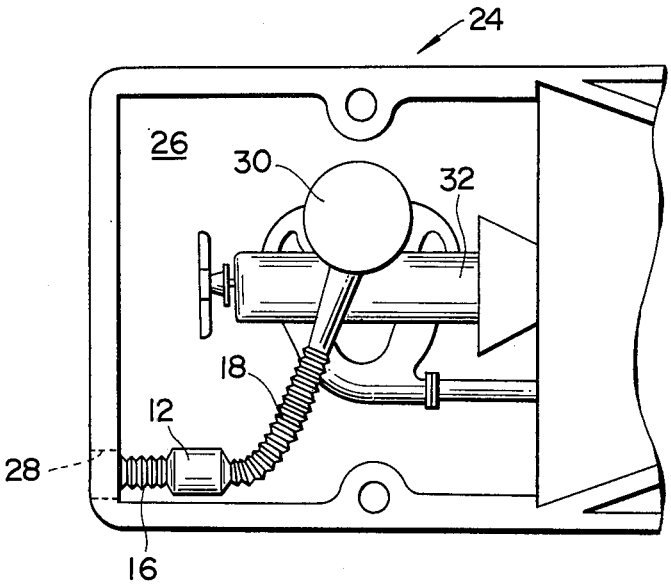
FIG. 3 is a schemmatic plan view of a vehicle showing a possible disposition of the silencer of the present invention in the induction system of the vehicle.

FIG. 3, showns schematically a plan of a vehicle 24 and more particularly the engine compartment 26 thereof. The silencer according to the present invention is shown mounted at the front of the engine compartment with the conduit 16 connected to an air induction port 28 formed in the body of the vehicle. The second conduit 18 is connected to the intake horn of an air cleaner 30 of the engine 32. With this arrangement, a minimum of vibration is transmitted from the air cleaner 30 to the silencer through the conduit 18 and what vibration reaches the silencer is not converted into secondary noise as in the case of the metallic arrangement of the prior art. Thus, secondary noise is prevented while the suppression of induction noises such as that produced by the operation of exhaust secondary air induction reed valves and the like is enhanced over the prior art due to the unique combination of the porous metal tube 10 and non-metallic housing 12.

It is further within the scope of the present invention to use the silencer as set forth hereinbefore in the exhaust system instead of or in addition to the induction system as shown in FIG. 3. However, in this case it is necesary to form the conduits 16 and 18 and the outer housing 12 of materials which are non-flammable and which have an adequate thermal resistance.

What is claimed is:

1. A silencer for use with an internal combustion engine comprising:

a foam metal tube; and a non-metallic, vibration absorbing housing disposed about said tube to define a closed empty chamber between the inner surface of said housing and the outer surface of said tube.

2. A silencer for use with an internal combustion engine comprising:

a foam metal tube which is porous along the entire length thereof;

a non-metallic, vibration absorbing housing disposed about said metal tube to define a closed empty chamber between the inner surface of said housing and the outer surface of said metal tube;

a first flexible conduit sealingly fitted onto one end of said foam metal tube and sealingly abutting a first end of said housing; and a second flexible conduit sealingly fitted onto the other end of said foam metal tube and sealingly abutting a second end of said housing.

3. A silencer as claimed in claim 1, further comprising:

a first flexible conduit sealingly fitted onto one end of said foam metal tube and sealingly abutting a first end of said housing; and a second flexible conduit sealingly fitted onto the other end of said foam metal tube and sealingly abutting a second end of said housing.

4. A silencer as claimed in claims 1 or 2, wherein said foam metal tube is made of sintered aluminum powder.

5. A silencer as claimed in claims 1 or 2, wherein said non-metallic, vibration absorbing housing is made of a mixture of fibers and a cross-linked phenolic resin.

6. A silencer as claimed in claims 1 or 2, wherein said non-metallic, vibration absorbing housing is a sandwich comprising a core of foamed synthetic resin and outer layers of a thermohardening resin sandwiching and impregnating said core.

7. In a vehicle having:

an internal combustion engine;

an induction system;

an air cleaner forming part of the induction system; and an improved silencer for the induction system, the improvement to the silencer comprising:

said silencer including a foam metal tube and a flexible air tight housing disposed thereabout to define a closed empty resonance chamber;

a first flexible conduit fluidly communicating with one end of said foam metal tube, said first flexible tube leading to the atmosphere; and a second flexible conduit fluidly communicating with the other end of said foam metal tube, said second flexible tube leading to the air cleaner.

* * * * *